US011458592B2

(12) United States Patent
Chen

(10) Patent No.: US 11,458,592 B2
(45) Date of Patent: Oct. 4, 2022

(54) SAND SOURCE SELECTING STRUCTURE FOR A SANDBLASTING GUN

(71) Applicant: LEMATEC CO., LTD, Taichung (TW)

(72) Inventor: Vic Chen, Changhua (TW)

(73) Assignee: LEMATEC CO., LTD, Changhua (TW)

( * ) Notice: Subject to any disclaimer, the term of this patent is extended or adjusted under 35 U.S.C. 154(b) by 406 days.

(21) Appl. No.: 16/673,142

(22) Filed: Nov. 4, 2019

(65) Prior Publication Data

US 2021/0129291 A1 May 6, 2021

(51) Int. Cl.
*B24C 11/00* (2006.01)
*B24C 7/00* (2006.01)
*B24C 5/02* (2006.01)

(52) U.S. Cl.
CPC ..... *B24C 11/00* (2013.01); *B24C 5/02* (2013.01); *B24C 7/0046* (2013.01)

(58) Field of Classification Search
CPC .... B24C 3/14; B24C 3/22; B24C 3/28; B24C 3/04; B24C 3/06; B24C 5/02; B24C 5/04; B24C 7/0046; B24C 7/053; B24C 7/0061; B24C 7/0069; B24C 1/04
USPC ..... 451/38, 90, 101, 102
See application file for complete search history.

(56) References Cited

U.S. PATENT DOCUMENTS 825,381 A * 7/1906 Coleman ..... B05B 11/062 451/75
998,762 A * 7/1911 Faller ..... B28C 5/026 261/DIG. 26
1,362,228 A * 12/1920 Cleveland ..... B05B 7/02 239/428
2,526,403 A * 10/1950 Paasche ..... B24C 5/02 451/90
2,577,465 A * 12/1951 Jones ..... B24C 3/06 451/90
2,628,456 A * 2/1953 Berg ..... B24C 3/065 451/87
3,266,193 A * 8/1966 McCune ..... B24C 11/00 451/99
3,664,372 A * 5/1972 Marshall ..... F16K 5/0492 251/312
4,628,644 A * 12/1986 Somers ..... B24C 5/02 222/630
6,383,062 B1 * 5/2002 Jou ..... B24C 5/02 239/375
7,341,504 B1 * 3/2008 Chen ..... B24C 5/02 239/375
2016/0158915 A1 * 6/2016 Adan ..... B24C 7/0084 451/90

* cited by examiner

*Primary Examiner* — Joel D Crandall
*Assistant Examiner* — Jason Khalil Hawkins

(57) ABSTRACT

A sand source selecting structure for a sandblasting gun has a main body; a channel provided in the main body, for passing pressurized gas; at least two sub-channels provided in the main body respectively connected to the channel; a sandbox mounted on the main body connected to the channel through the first sub-channel; a first control valve installed in the first sub-channel; and a second control valve installed in the second sub-channel. Therefore, the combination of the first control valve with the second valve provides a selecting structure, which can offer different sand supply sources.

4 Claims, 4 Drawing Sheets

SAND SOURCE SELECTING STRUCTURE FOR A SANDBLASTING GUN

BACKGROUND OF INVENTION

Field of Invention

The present invention relates to a sandblasting gun, and more particularly to a sand source selecting structure for a sandblasting gun.

Description of the Related Art

Typical sandblasting guns spray some sand particles on the surface of a metal workpiece by pressurized gas to perform surface treatment such as rust removal and dust-proof, thereby preventing water molecules or impurities from adhering to the surface of the metal and preventing the metal workpiece from being rusted or damaged.

For larger metal workpieces, sandblasting guns require more sand, and smaller metal work pieces emit less sand.

However, typical sandblasting gun is equipped with a sandbox, and the sandbox obtains a fixed amount of sand and cannot increase the amount of sand easily.

Therefore, it is desirable to provide a sand source selecting structure for a sandblasting gun to mitigate and/or obviate the aforementioned problems.

SUMMARY OF THE INVENTION

An objective of present invention is to provide a sand source selecting structure for a sandblasting gun, which is capable of improving the above-mentioned problems.

In order to achieve the above mentioned objective, the sand source selecting structure for a sandblasting gun has:

a main body;

a channel provided in the main body, for passing pressurized gas;

at least two sub-channels provided in the main body respectively connected to the channel;

a sandbox mounted on the main body connected to the channel through the first sub-channel;

a first control valve installed in the first sub-channel; and a second control valve installed in the second sub-channel.

Therefore, the combination of the first control valve and the second valve provides a selecting structure, which can offer different sand supply sources.

Other objects, advantages, and novel features of invention will become more apparent from the following detailed description when taken in conjunction with the accompanying drawings.

DETAILED DESCRIPTION OF THE PREFERRED EMBODIMENT

Figure 1:
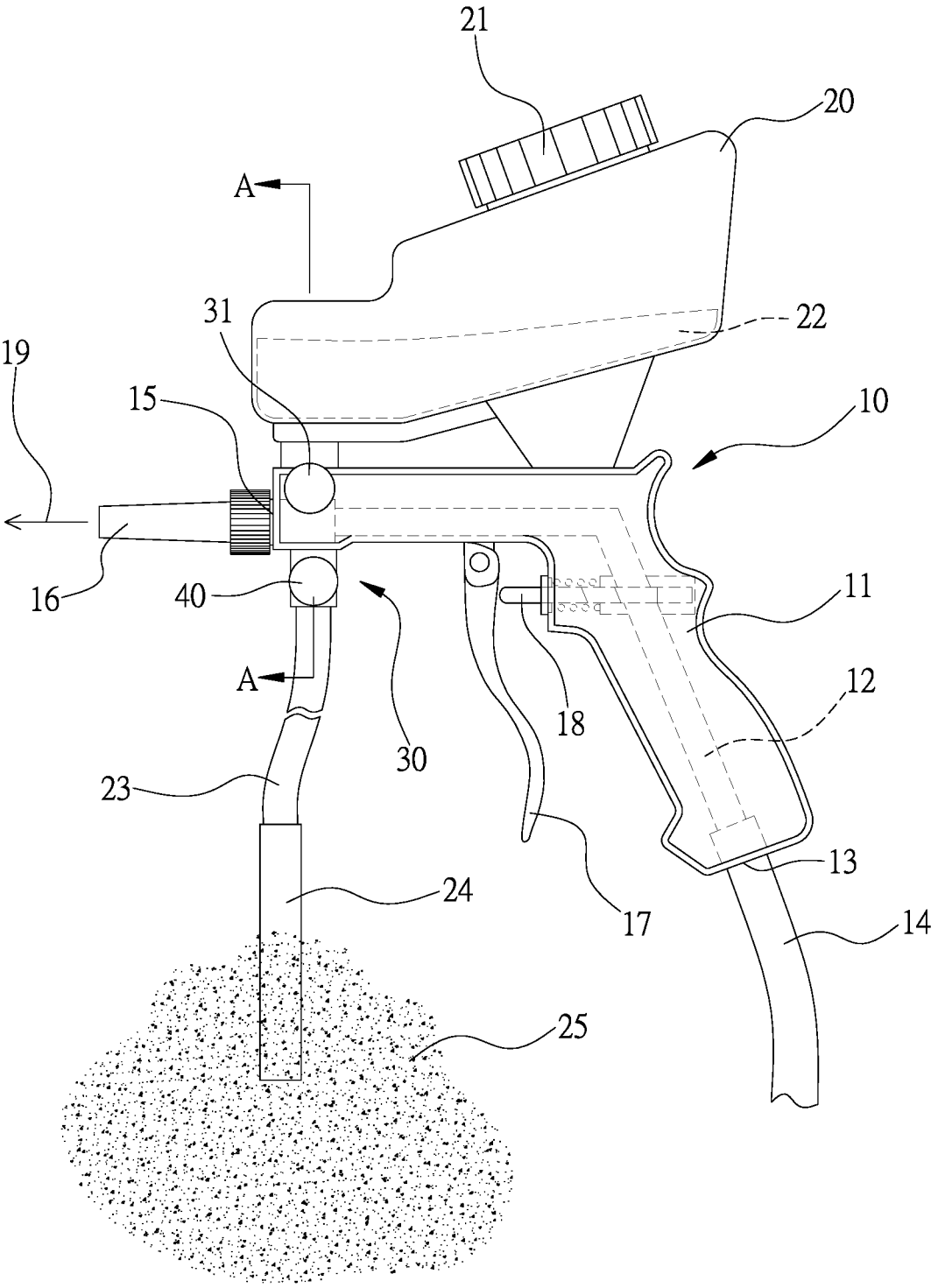
FIG. 1 is a structure plan view of a preferred embodiment for use with a sandblasting gun according to the present invention.

Please refer to FIG. 1. a sandblasting gun 10 has a main body 11, and the main body 11 has a handgun-shaped profile.

The main body 11 has a channel 12, and the channel 12 is provided with an entering end 13 and an exiting end 15, and the entering end 13 and a pressurized gas device (such as an air compressor) are connected by a gas pipe 14. A detachable nozzle 16 is connected to the main body 11, and the nozzle 16 is connected to the exiting end 15 of the channel 12.

A gas valve 18 is installed onto the main body 11 to intercept the channel 12. A trigger 17 is mounted to the main body 11 and able to swing back and forth, and the trigger 17 controls the gas valve 18 to keep the entering end 13 and the exiting end 15 of the channel 12 clear, so that the pressurized gas in the gas pipe 14 enters into the channel 12. With the guidance of the nozzle 16, a gas flow 19 is ejected out of the main body 11.

As shown, a sandbox 20 is secured to the main body 11 for receiving some sand particles 22. A cover 21 locks the sandbox 20 to prevent the sand 22 from exiting the sandbox 20.

Further, a selecting structure 30 is composed of a first control valve 31 and a second control valve 40, and the first and second control valves 31, 40 are mounted on the main body 11 adjacent to the nozzle 16.

Figure 2:
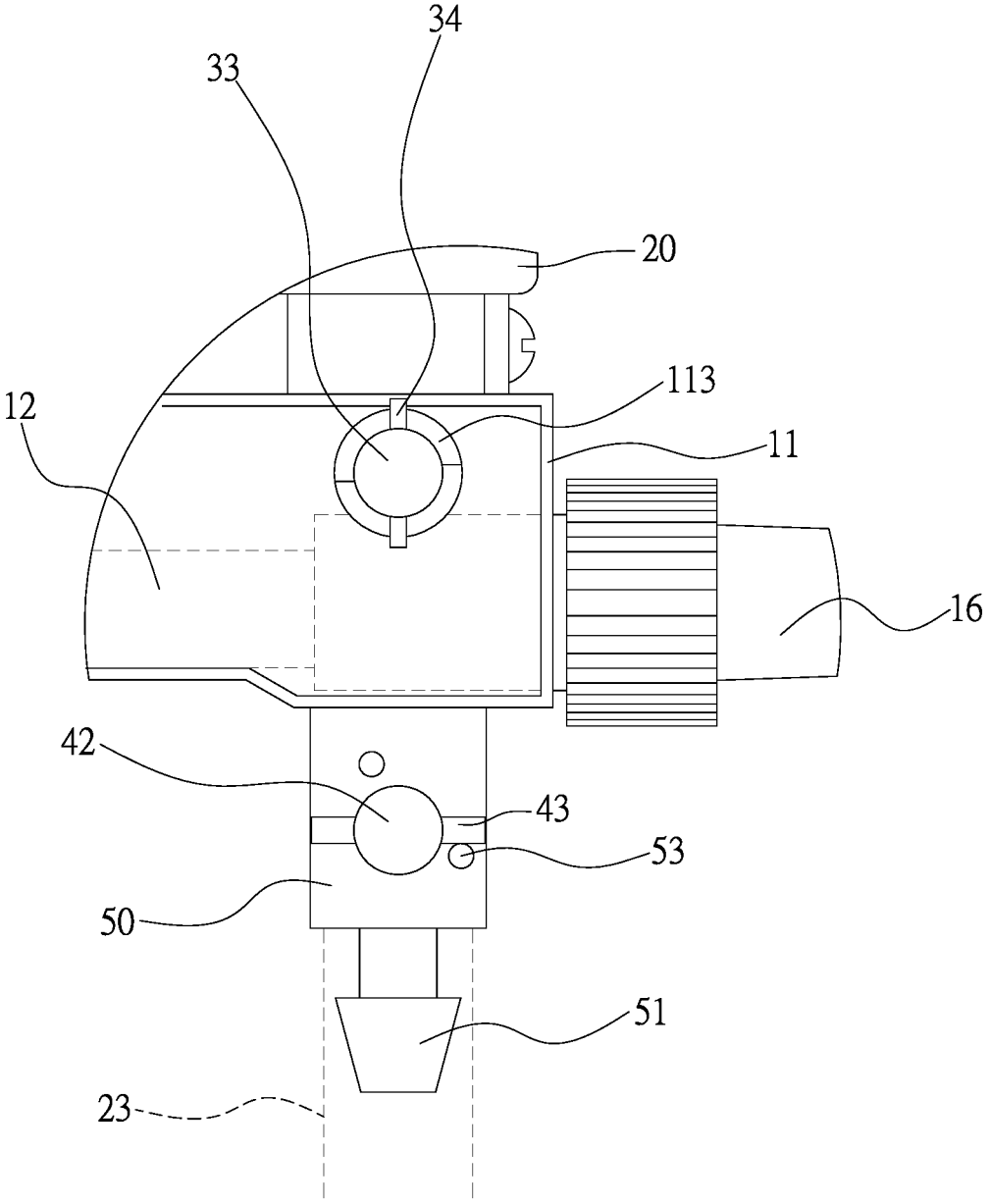
FIG. 2 is a plan view of another angle of the selecting structure.
Figure 3:
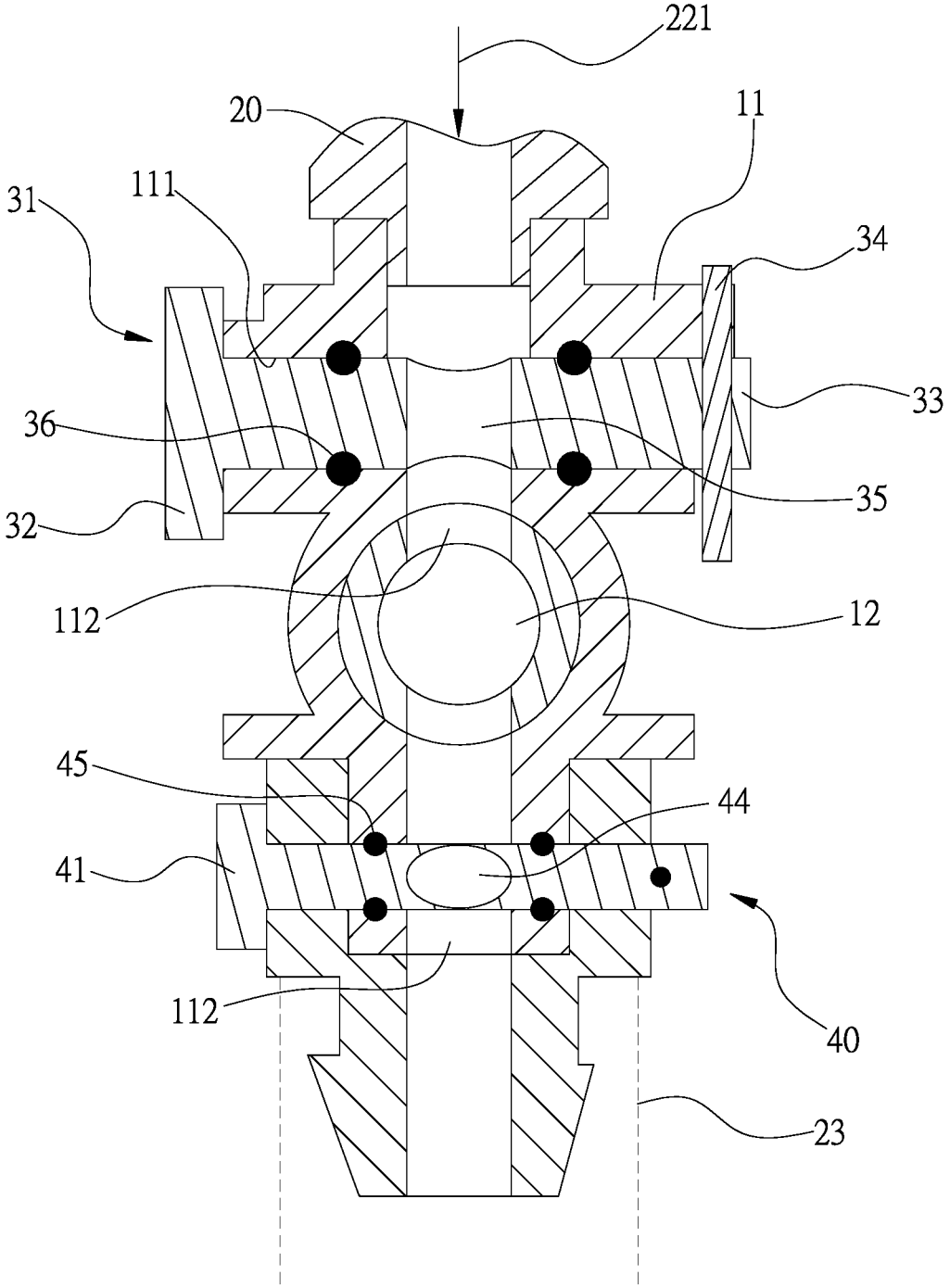
FIG. 3 is a cross-sectional view along a line A-A of FIG. 1.

Please refer to FIGS. 2 and 3, the coupling relationship between the main body 11 and the first control valve 31 is described in detail. Two sub-channels 112 are made in the main body 11, and the sub-channels 112 are connected to the channel 12 of the main body 11. The first control valve 31 has a first valve rod 33, the first valve rod 33 is provided with a knob 32 and a first through aperture 35. The knob 32 is formed at one end of the first valve rod 33, and the first through aperture 35 connects both sides of the first valve rod 33.

When one end of the first valve rod 33 passes through an assembly aperture 111 of the main body 11, a pin 34 is inserted into a portion of the first valve rod 33 that is located out of the main body 11. The pin 34 prevents the first valve rod 33 from leaving the main body 11 without interfering with operation of the knob 32 to rotate the first valve rod 33 relative to the main body 11. In addition, a first set of rings 36 is embedded in the surface of the first valve rod 33 around the first through aperture 35 while contacting the main body 11 to form a wall for the assembly aperture 111, thereby providing sealing effect to prevent pressure leakage.

In a preferred embodiment, the main body 11 further has two baffles 113 protruding out from the surface and disposed on two sides of the first valve rod 33, and the baffles 113 block the pin 34 and hence limit the first valve rod 33 to rotation or spin between longitudinal and transverse positions. That is, the pin 34 abuts against a corresponding one of the baffles 113 when the first valve rod 33 is in the longitudinal or transverse position.

When the first valve rod 33 is at the longitudinal position, the axial direction of the first through aperture 35 is substantially parallel to the length direction of the first sub-channel 112, so the first sub-channel 112 is opened. Therefore, the pressurized gas in the channel 12 produces suction to the first sub-channel 112. Since the sandbox 20 is internally connected to the first sub-channel 112, the sand in the sandbox 20 is mixed with pressurized gas in the first sub-channel 112 along the direction of an arrow head 221 and is ejected to the outside of the main body 11 via the channel 12.

Figure 4:
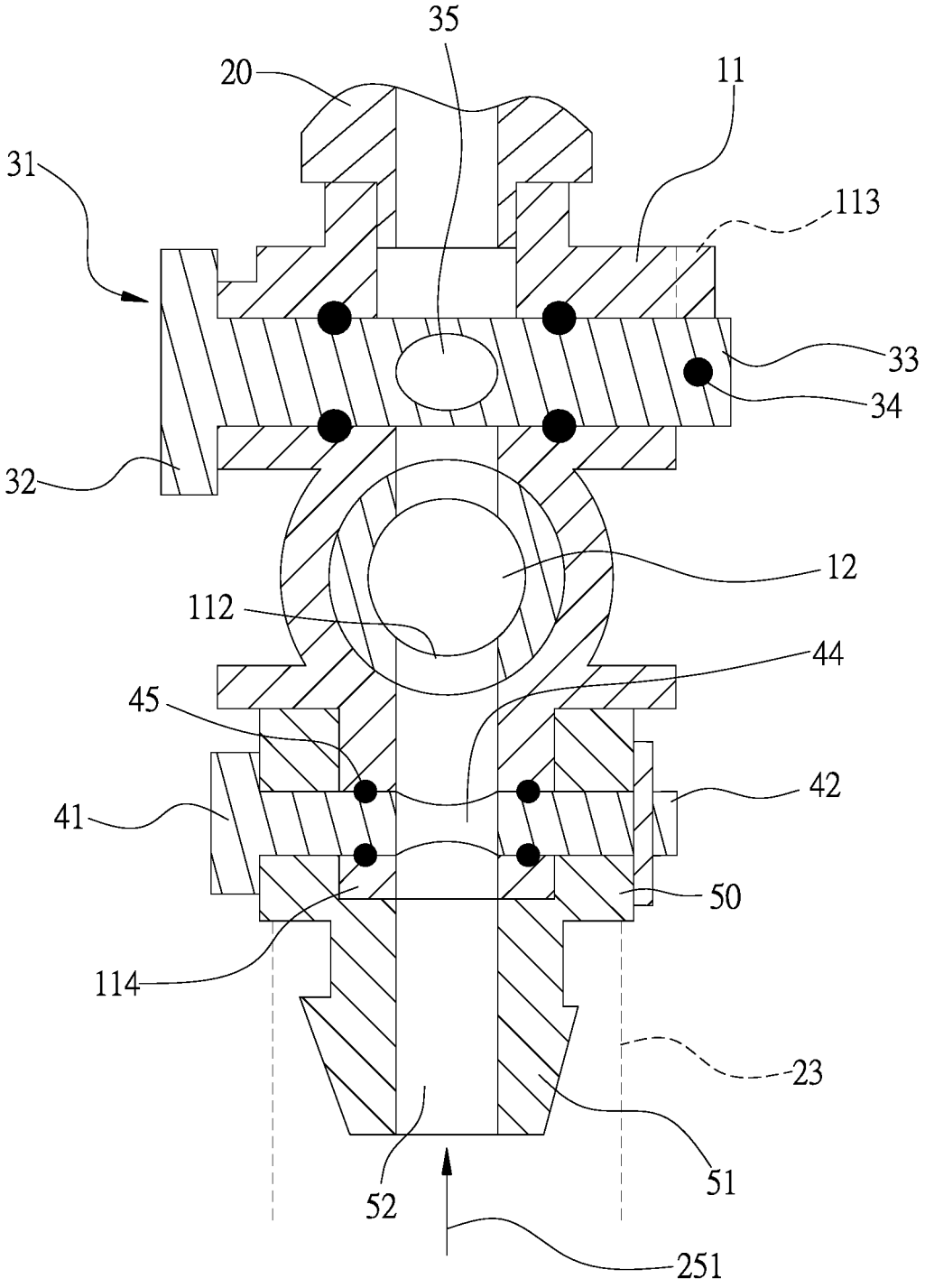
FIG. 4 is an action drawing for selecting a sand source.

As shown in FIG. 4, in the transverse position, the axial direction of the first through aperture 35 is substantially perpendicular to the length direction of the first sub-channel 112, so the first sub-channel 112 is cut-off by the surface of the first valve rod 33. Therefore, the pressurized gas in the channel 12 does not make effect on the sandbox 20, and the sand of the sandbox 20 naturally does not enter the channel 12.

In other words, the first control valve 31 controls whether the sand in the sandbox 20 enters the channel 12 or not.

Referring to FIGS. 2 and 4, the main body 11 has a protruding portion 114, the protruding portion 114 and the sandbox 20 are disposed on two opposite sides of the main body 11, and the sub-channel 112 extends through the interior of the protruding portion 114. Furthermore, the second control valve 40 is composed of a second valve rod 42 and a connector 50. The second valve rod 42 is substantially identical to the first valve rod 33, and has a second knob 41, a second through aperture 44 and a second set of rings 45. The connector 50 has an inserting portion 51, and the inserting portion 51 is a round tube and has an inner chamber 52.

When the connector 50 is sleeved onto the protruding portion 114, and the second valve rod 42 passes through the protruding portion 114 and the connector 50. Moreover, a second pin 43 is inserted into a portion of the second valve rod 42 located outside the connector 50, therefore the connector 50 can be prevented from leaving the protruding portion 114 without interfering with operation of the second knob 41 to rotate the second valve rod 42 relative to the connector 50. Additionally, two baffles 53 extend from the surface of the connector 50, near the second valve rod 42. The baffles 53 abut against the second pin 43 and hence limit the second valve rod 42 to rotation or spin between longitudinal and transverse positions. That is, the pin 43 abuts against a corresponding one of the baffles 53 when the second valve rod 42 is in the longitudinal or transverse position. The second set of rings 45 touches the protruding portion 114 (or the connector 50) and has a sealing effect that prevents pressure leakage.

An opening of a hose 23 is jacketed onto the inserting portion 51, and the inner chamber 52 of the inserting portion 51 is connected to the hose 23. Another opening of the hose 23 is connected to a rigid tube 24 inserted into a sand pile 25 (see FIG. 1).

When the second valve rod 42 is at the longitudinal position, the axial direction of the second through aperture 44 is parallel to the length direction of the second sub-channel 112, so that the second sub-channel 112 is opened. The pressurized gas in the channel 12 generates suction to the sand pile 25 (see FIG. 1) through the hose 23 and the rigid tube 24, so that the sand particles are mixed with the pressurized gas and sprayed out of the main body 11 via the channel 12 as the direction of an arrow head 251.

As shown in FIG. 3, when the second valve rod 42 is at the transverse position, the axial direction of the second through aperture 44 is substantially perpendicular to the length direction of the second sub-channel 112, therefore the second sub-channel 112 is cut-off by the surface of the second valve rod 42. The pressurized gas is blocked by the second valve rod 42 and has no effect on the sand pile 25 (see FIG. 1), and the sand naturally does not enter the channel 12 via the hose 23.

Basically, the second control valve 40 is the controller that controls the pressurized gas in the channel 12 to extract the sand pile 25 (see FIG. 1) through the hard tube and the hose 23.

Even the first control valve 31 and the second control valve 40 are independent of each other and can be turned on and off respectively, but simultaneously turning on or off the first and second control valves 31, 40 should still be applied within range of the present invention.

Although the present invention has been explained in relation to its preferred embodiment, it is to be understood that many other possible modifications and variations can be made without departing from the spirit and scope of invention as hereinafter claimed.

What is claimed is:

1. A sand source selecting structure for a sandblasting gun comprising:

a main body formed with first and second pairs of baffles;

a channel provided in the main body, for passing pressurized gas;

first and second sub-channels provided in the main body and connected to the channel;

a sandbox mounted on the main body so that the sand box is in communication with the channel through the first sub-channel;

a hose connected to the main body so that the hose is in communication with the channel via the second sub-channel;

a first control valve comprising:

a first valve rod transversely extending through the first sub-channel and comprising a first aperture, wherein the first valve rod is rotatable between a position where the first aperture is parallel to the first sub-channel and another position where the first aperture is perpendicular to the first sub-channel;

a first knob formed at an end of the first valve rod; and a first pin transversely extending through another end of the first valve rod, wherein the first pin abuts against one of the baffles in the first pair when the first valve rod is in a corresponding one of the positions; and a second control valve comprising:

a second valve rod transversely extending through the second sub-channel and comprising a second aperture, wherein the second valve rod is rotatable between a position where the second aperture is parallel to the second sub-channel and another position where the second aperture is perpendicular to the second sub-channel;

a second knob formed at an end of the second valve rod; and a second pin transversely extending through another end of the second valve rod, wherein the second pin abuts against one of the baffles in the second pair when the second valve rod is in a corresponding one of the positions.

2. The sand source selecting structure of a sandblasting gun as claimed in claim 1, further comprising a first set of rings disposed around the first aperture, and wherein the first set of rings is in contact with the first valve rod and the main body for a sealing purpose.

3. The sand source selecting structure of a sandblasting gun as claimed in claim 1, wherein the second control valve comprises:

a connector having an inserting portion with an inner chamber, wherein the inserting portion is inserted in the hose so that the second sub-channel is in communication with the hose via the inner chamber of the connector;

wherein when the connector jackets onto a protruding portion of the main body, the second valve rod passes the protruding portion and the connector.

4. The sand source selecting structure of a sandblasting gun as claimed in claim 3, further comprising a second set of rings disposed around the second aperture, and wherein the second set of rings is in contact with the second valve rod and the protruding portion for a sealing purpose.

* * * * *